US007581663B2

(12) United States Patent
Richaud et al.

(10) Patent No.: US 7,581,663 B2
(45) Date of Patent: Sep. 1, 2009

(54) RIPPLED SURFACE STOPPER ROD SYSTEM

(75) Inventors: Johan L. Richaud, Dundas (CA); Lawrence J. Heaslip, Burlington (CA); James Dorricott, Burlington (CA)

(73) Assignee: Vesuvius Crucible Company, Wilmington, DE (US)

( * ) Notice: Subject to any disclaimer, the term of this patent is extended or adjusted under 35 U.S.C. 154(b) by 586 days.

(21) Appl. No.: 10/576,999

(22) PCT Filed: Nov. 3, 2004

(86) PCT No.: PCT/US2004/036718

§ 371 (c)(1),
(2), (4) Date: Apr. 25, 2006

(87) PCT Pub. No.: WO2005/042189

PCT Pub. Date: May 12, 2005

(65) Prior Publication Data

US 2007/0120299 A1 May 31, 2007

Related U.S. Application Data

(60) Provisional application No. 60/516,902, filed on Nov. 3, 2003.

(51) Int. Cl.
*C21B 7/16* (2006.01)

(52) U.S. Cl. ..... 222/594; 222/602

(58) Field of Classification Search ..... 222/590, 222/591, 594, 597, 602; 266/236
See application file for complete search history.

(56) References Cited

U.S. PATENT DOCUMENTS

2004/0100002 A1 * 5/2004 Richaud ..... 266/266

FOREIGN PATENT DOCUMENTS

JP 62 089566 A 4/1987
WO WO 02081123 A2 * 10/2002

* cited by examiner

*Primary Examiner*—Scott Kastler
(74) *Attorney, Agent, or Firm*—Thomas J. Clinton; Donald M. Satina

(57) ABSTRACT

The present invention concerns stopper rod system for use in a metallurgical vessel, comprising a stopper rod and a nozzle. At least one of the stopper rod nose and the internal surface of the nozzle bore comprise a plurality of ripples that are arranged such that the size of a flow channel between the stopper rod nose and the internal stopper rod when the stopper rod system is in an open position discontinuously increases in size as a function of the distance downstream from the point of contact between the stopper rod and the nozzle.

12 Claims, 4 Drawing Sheets

RIPPLED SURFACE STOPPER ROD SYSTEM

CROSS-REFERENCE TO RELATED APPLICATIONS

This application claims the benefit under 35 U.S.C. §120 of the filing date of U.S. Provisional Application No. 60/516,902 filed Nov. 3, 2003.

FIELD OF THE INVENTION

The present invention generally relates to an apparatus for regulating the rate of metal flow out of a vessel that contains liquid metal. More specifically, the present invention relates to an improved stopper rod system.

DESCRIPTION OF THE RELATED ART

In the processing of molten or liquid metals, for example, steel, the flow of liquid metal proceeds from a metallurgical container, such as a ladle, into a tundish. The liquid metal then proceeds through the tundish into a mold. At or near the bottom of the tundish, the flow of liquid metal out of the tundish and into the mold is controlled. Generally, the flow is controlled using a stopper rod system.

The stopper rod system is comprised of a moveable stopper rod and a nozzle. The nozzle has a bore through which the liquid metal is allowed to flow. The flow of liquid metal out of the tundish through the nozzle bore is generated by the action of gravity. The stopper rod has an end or nose immersed in the liquid metal that mates with an entry portion of the nozzle bore, such that if the stopper nose is moved into contact with the nozzle, the nozzle bore is blocked and liquid metal flow is stopped. When the stopper rod nose is moved away from contact with the nozzle, an aperture between the stopper nose and the nozzle bore is formed, allowing liquid metal to flow from the vessel through the nozzle bore. Through precise movement of the stopper rod, the rate of liquid metal flow is regulated, while maintaining a close proximity between the stopper rod nose and the nozzle bore. In this way, adjusting the size of the aperture regulates the flow rate of the liquid metal. In particular, the present invention relates to the shape of the stopper rod nose and/or to the shape of the nozzle surface.

One problem in traditional stopper rod systems is clogging or restriction of the liquid metal flow by the deposition and aggregation of non-metallic materials on the stopper nose and/or on the nozzle bore surface. This deposition leads to difficulties in properly regulating the liquid metal flow. As a result of the build-up of clogging deposits, the desired rate of liquid metal flow may be impossible to maintain leading to early termination of the process. Also, the metal flow may suddenly surge if a portion of a clogging deposit breaks free and is carried away by the metal flow. Poor regulation of the liquid metal flow as induced by clogging leads to quality defects in the metal products. Previous stopper rod systems have attempted to deal with the problem of clogging using a rugged dimpled geometry, or by the introduction of gas into the metal flow through a porous element in the stopper nose. Examples of such prior stopper rod systems are disclosed by Japan. Pat. No.62089566-Apr. 24, 1987 and U.S. Pat. No. 5,071,043.

However, the use of rugged surcidces as taught by Japan. Pat. 62089566 leads to poor regulation of the metal flow, as aperture size is not a smooth function of the separation between the nozzle bore and the stopper nose. This rugged geometry also causes problems in sealing between the stopper nose and the nozzle bore when it is necessary to shut-off the metal flow because the recesses in the rugged surfaces are by-passed by the liquid metal flow thus entrapping liquid metal in the recesses where it can clog the flow by freezing.

U.S. Pat. No. 5,071,043 discloses the use of a porous stopper nose to allow the introduction of bubbles of an inert gas such as argon into the metal flow. The introduction of gas helps to reduce clogging by providing bubbles to which the non-metallic particles in the liquid metal may preferentially attach, thereby reducing build-up on the stopper nose or nozzle bore. However, the gas injected through the stopper nose does not generally form a uniform distribution of gas bubbles throughout the metal flowing through the aperture. The gas follows the path of least resistance and may reach the liquid metal and form bubbles only on one side of the aperture, or only in portions of the metal flow. When this occurs, the clogging is asymmetric, leading to non-uniform flow through the aperture, and, in turn, poor regulation of the metal flow.

The present invention corrects the deficiencies of the previous stopper rod systems by providing a stopper rod system with a uniquely designed stopper nose and nozzle bore that control the scale and location of turbulence in the metal flow. The present design reduces clogging deposition, and improves the distribution of gas bubbles in the metal flow when gas is introduced into the system.

SUMMARY OF THE INVENTION

The present invention provides a stopper rod system for use in a metallurgical vessel. The stopper rod system comprises a stopper rod having a nose on one end thereof, and a nozzle having a bore therethrough, the bore having an internal surface. The stopper rod nose and the internal surface of the nozzle bore have a point of contact when the stopper rod system is in a closed position. At least one of the stopper rod nose and the internal surface of the nozzle bore comprises a plurality of ripples that are arranged such that the size of a flow channel between the stopper rod nose and the internal stopper rod when the stopper rod system is In an open position discontinuously increases in size as a function of the distance downstream from the point of contact.

Another embodiment of the present invention provides stopper rod for use in a stopper rod system. The stopper rod system comprises the stopper rod having a nose on one end thereof, and a nozzle having a bore therethrough, the bore having an internal surface. The stopper rod nose and the internal surface of the nozzle bore have a point of contact when the stopper rod system is in a closed position. The stopper rod nose comprises a plurality of ripples that are arranged such that the size of a flow channel between the stopper rod nose and the internal stopper rod when the stopper rod system is In an open position discontinuously increases in size as a function of the distance downstream from the point of contact.

Another embodiment of the present invention provides nozzle for use in a stopper rod system. The stopper rod system comprises a stopper rod having a nose on one and the nozzle having a bore therethrough, the bore having an internal surface. The stopper rod nose and the internal surface of the nozzle bore have a point of contact when the stopper rod system is in a closed position. The nozzle comprises a plurality of ripples that are arranged such that the size of a flow channel between the stopper rod nose and the internal stopper rod when the stopper rod system is in an open position discontinuously increases in size as a function of the distance downstream from the point of contact.

DESCRIPTION OF THE SEVERAL FIGURES

Figure 4:
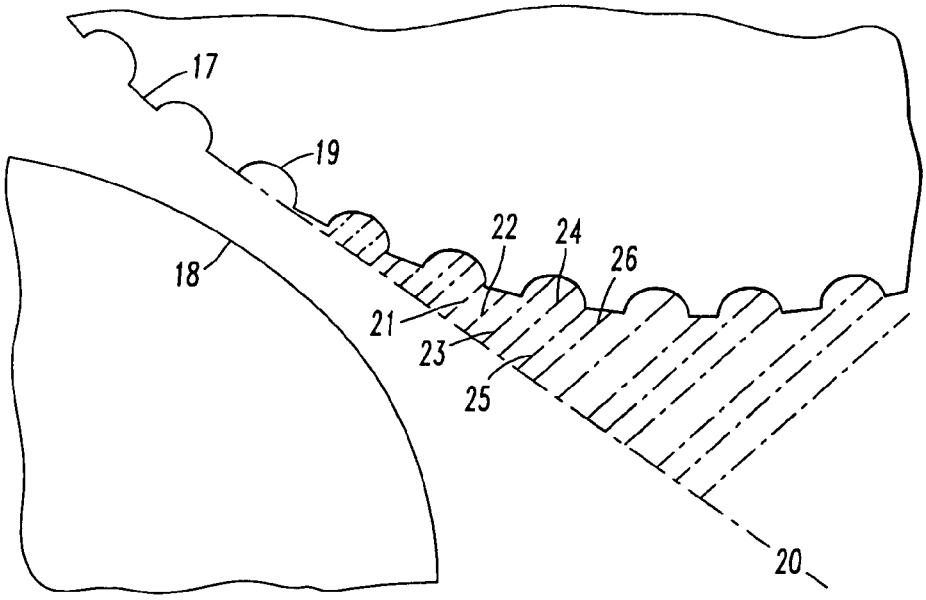
FIG. 4 PRIOR ART

FIG. 4 is a cross-sectional view of showing the localized flow patterns in a stopper rod system as disclosed in by Japan. Pat. No.62089566-24/04/87.

Figure 5:
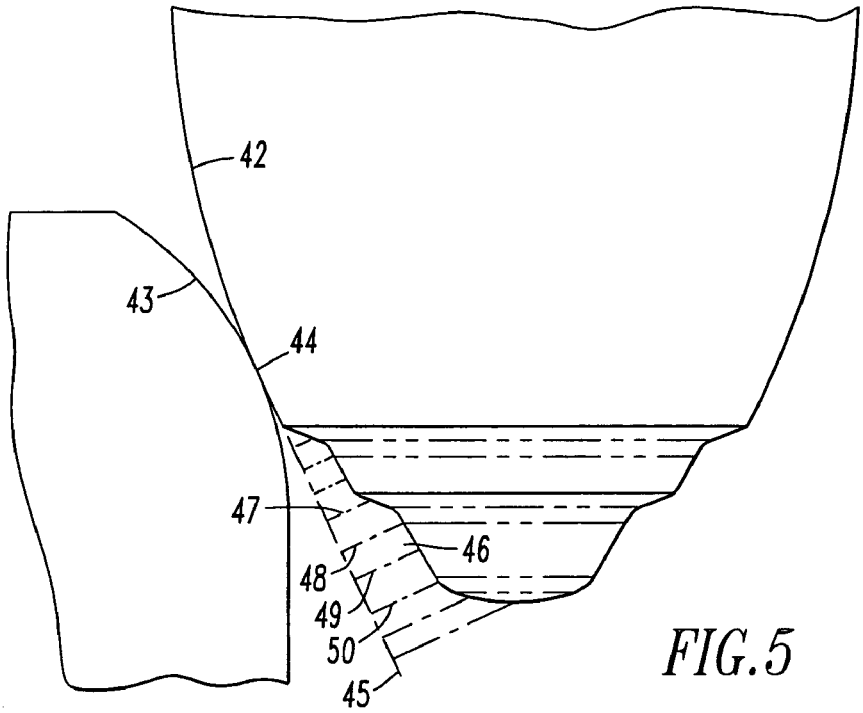

FIG. 5 is a cross-sectional view of a stopper rod system according to one embodiment of the present invention.

Figure 6:
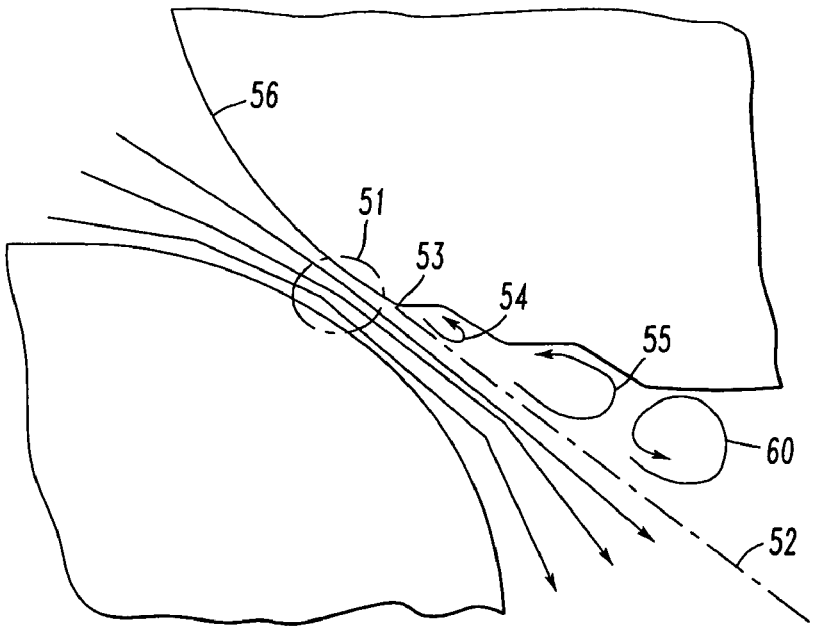

FIG. 6 is a cross-sectional view of a cross-sectional view of the stopper rod system of FIG. 5, showing localized flow patterns.

Figure 7:
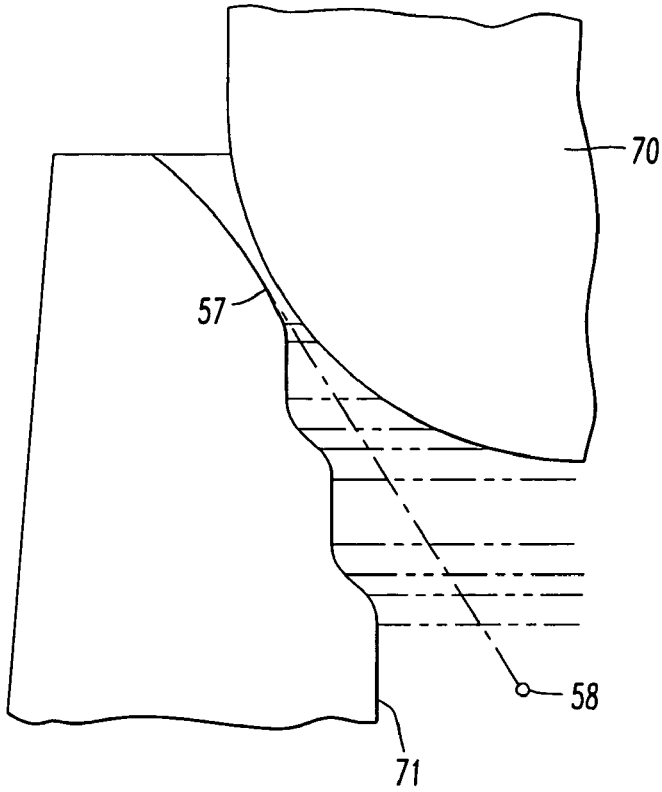

FIG. 7 is a cross-sectional view of a stopper rod system according to an alternate embodiment of the present invention.

Figure 8:
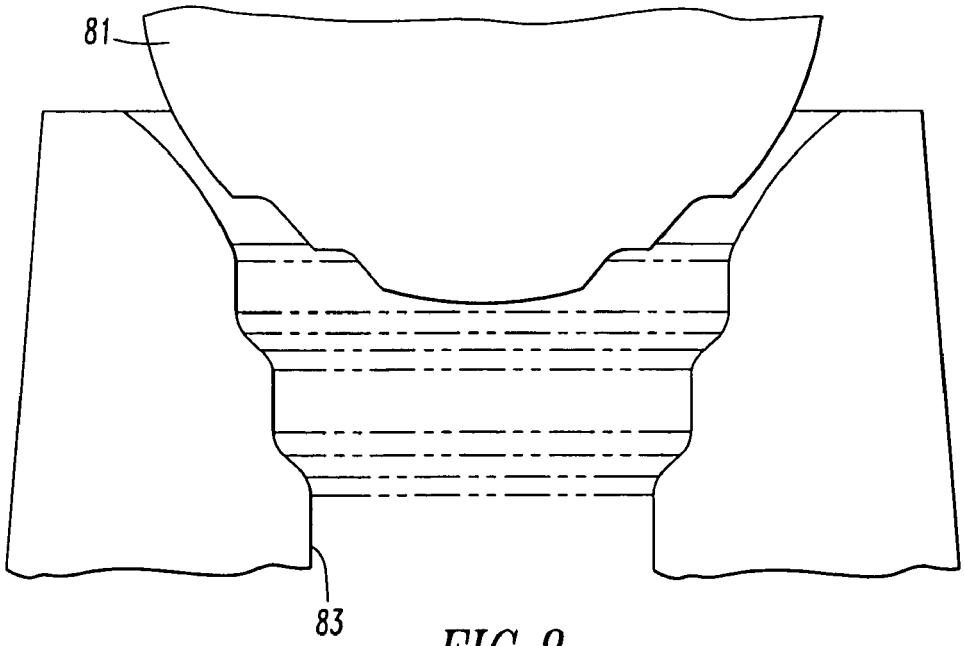

FIG. 8 is a cross-sectional view of a stopper rod system according to an alternate embodiment of the present invention.

DETAILED DESCRIPTION OF THE PREFERRED EMBODIMENTS

Figure 1:
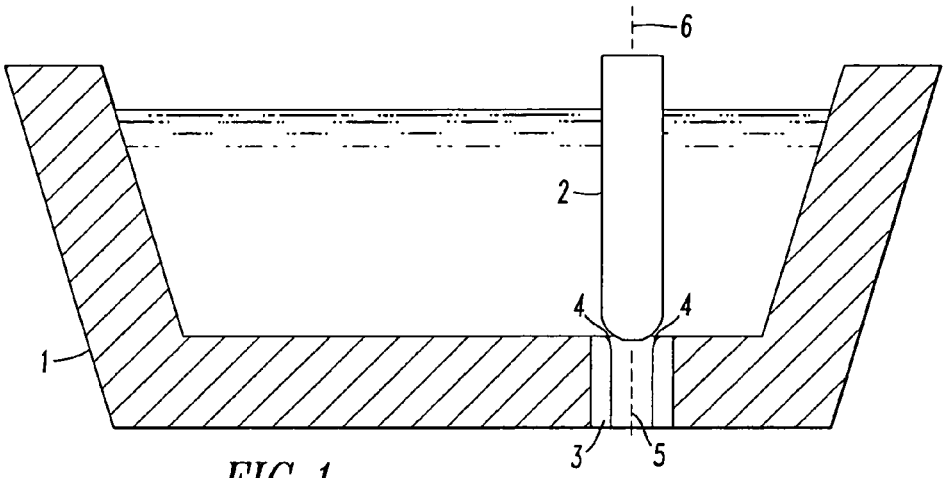
FIG. 1 PRIOR ART
FIG. 1 is a cross-sectional view of a typical tundish utilized in the processing of liquid metal.

FIG. 1 illustrates a traditional tundish configuration. In the tundish 1, a stopper rod 2 having center axis 6 is aligned with the center axis 5 of the nozzle 3 and is used to regulate liquid metal flow through an aperture 4.

Figure 2:
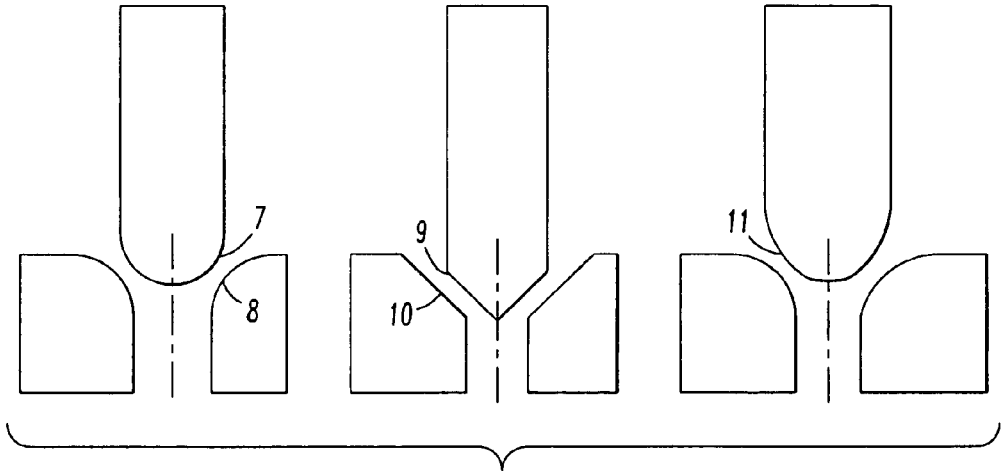
FIG. 2 PRIOR ART
FIG. 2 is a cross-sectional view of traditional stopper rod systems.

FIG. 2 illustrates several alternative geometric configurations of the traditional stopper rod systems. Stopper rod 7 has a round or hemispherical nose which mates with the rounded entrance surface 8 of the nozzle bore. Alternatively, stopper rod 9 has a pointed or conical nose that mates with the tapered or conical nozzle bore entrance 10. Alternatively, stopper rod 11 has a multi-radius or bullet-shaped nose.

Figure 3:
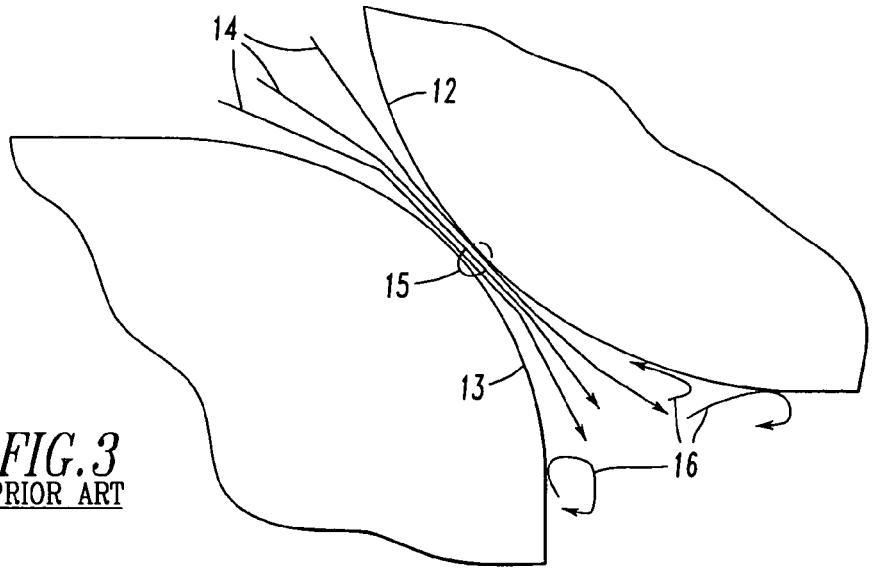
FIG. 3 PRIOR ART
FIG. 3 is a cross-sectional view showing the localized flow patterns in a traditional stopper rod system.

FIG. 3 is a close-up view around the regulation area in a traditional configuration such as those illustrated in FIG. 2. Stopper rod nose 12 is positioned relative to a nozzle bore 13 so as to form an aperture 15 which regulates the liquid metal flow represented by streamlines 14. The aperture 15 lies along the line of closest proximity between the stopper nose 12 and the nozzle bore 13. Downstream of the aperture 15, the streamlines may detach from the surfaces of stopper rod nose 12 and nozzle bore 13 so as to cause uncontrolled turbulent eddies as represented by arrows 16. The turbulent eddies form in regions of the liquid flow downstream of the aperture 15 adjacent to the stopper nose surface 12 or the inner surface of nozzle bore 13. The turbulent eddies can appear and disappear in those two regions in an uncontrolled and unpredictable manner. The size or scale of the turbulent eddies is also time variant. Variations in the scale and location of the turbulent eddies generated in the flow downstream of the minimum aperture can affect the flow regulation so as to cause variation in the flow rate even when the stopper position, and thus the aperture size, is fixed.

FIG. 4 Illustrates a rugged surface as disclosed by Japanese patent 62089566. As shown in FIG. 4, the stopper rod nose surface 17 features multiple recesses 19. For illustrative purposes, only the surface of the stopper 17 in FIG. 4 features a rugged surface with recesses, although the reference also teaches that the nozzle bore may also have a rugged surface featuring similar recesses. Thus, in FIG. 4, the nozzle bore surface 18 is a shown as a smooth arc.

Line 20 is tangent to the general curvature of the stopper nose surface 17 and is connected to this surface at the aperture and extends in the general direction of metal flow downstream of the aperture. Lines 21, 22, 23, 24, 25, and 26 are examples of lines perpendicular to line 20 and are sequentially further from the aperture. The lengths of the various lines are proportional to the size of the flow channel that is formed downstream of the aperture. It is clear that the flow channel size does not smoothly increase in the downstream direction as the position along line 20 increases. In fact, the flow channel size increases rapidly at the entrance to each recess and then decreases at the lower (further downstream) section of each recess. For example, line 22 is longer than line 21, line 23 is longer than line 22, but line 24 is shorter than line 23, and line 25 is shorter than line 24. Line 26 is longer than line 25 as the position downstream approaches the next recess.

As used herein, in both the specification and the claims, the term "flow channel," when used in connection with the stopper rod, is used to define the area between the stopper rod nose and a line tangent to the stopper rod nose and parallel with the direction of flow of the liquid metal at the point of contact between the stopper rod nose and the inner surface of the nozzle bore. Likewise, as used herein, in both the specification and the claims, the term "flow channel," when used in connection with the nozzle, is used to define the area between the inner surface of the nozzle bore and a line tangent to the inner surface of the nozzle bore and parallel with the direction of flow of the liquid metal at the point of contact between the stopper rod nose and the inner surface of the nozzle bore.

It must be noted that the flow channel increases in size where the rugged surface is recessed, and thus, the rugged recesses are by-passed by the liquid metal flow. The by-pass of the recesses allows the entrapment of liquid metal in the recesses, resulting in a longer residence time for the entrapped liquid as compared to the liquid flowing nearby. The trapped liquid can also freeze within the recesses, causing clogging of the liquid metal flow. This rugged geometry also causes problems in sealing between the stopper nose and the nozzle bore when it is necessary to shut-off the metal flow.

Attention is now drawn to FIG. 5, which illustrates one embodiment of a stopper rod system of the present invention. Stopper rod nose 42 and outlet nozzle bore 43 shown are shown in a closed position. At point of contact 44, a tangent line 45 has been drawn tangent to the stopper nose surface and extending downstream from the contact point. The variation of the distance between tangent line 45 and stopper rod nose 42 downstream of contact point 45 is illustrated by the lines perpendicular to tangent line 45. Lines 47, 48, 49, and 50 are a series of such perpendicular lines at sequentially increasing distance from point 44. These lines illustrate that in this embodiment of the present invention, the surface of the stopper rod nose 42 comprises a plurality of depressions or ripples. The ripples are shaped so as to form a flow channel between the tangent line and the stopper rod nose 42 that progressively increases in size, but in a step-wise or discontinuous manner, as the distance downstream from the contact point 44 increases.

When the stopper rod nose 42 is moved away from contact with the nozzle bore 43, the aperture will be formed in the region of contact point 44 and the flow channel between the tangent line and the stopper nose will increase in a discontinuous manner as distance downstream of the aperture increases. For example, comparing lines 47 and 48 to lines 48 and 49, line 48 is longer than line 47, while line 49 is only slightly longer or the same length as line 47. Thus, the difference in length between lines 48 and 47 is significantly greater than the difference in length between lines 49 and 48. The rippled shape of stopper nose 42 provides this discontinuous increase in flow channel size.

It should be noted that the flow channel size does not decrease as a function of the distance downstream from the aperture. Instead, the flow channel size downstream of the aperture increases in a series of steps. In a preferable configuration, first, a small increase in size (as a function of the distance from the contact point 44) adjacent to the contact point 44 is used to assure good closure of the stopper system. This is preferably followed by a large increase, followed by a small increase or even no increase, followed by a large increase, followed by a small or no increase, etc.

FIG. 6 is illustrates the regulation area of one embodiment of the invention. Rippled stopper rod nose 56 is positioned relative to a nozzle bore 62 so as to form an aperture in region 51 which regulates the liquid metal flow represented by the streamlines. The aperture lies along the line of closest proximity between the stopper rod nose 56 and the nozzle bore 62. Downstream of the aperture, the streamlines detach from the surfaces of stopper rod nose 56 and form controlled turbulent eddies as represented by arrows 54, 55, and 60. Downstream of point 53, the distance between tangent line 52 and the stopper nose surface increases quickly in a first step causing the flow to be detached from the stopper nose and generating a first region of turbulent eddies as shown by arrow 54. Similarly, other turbulent eddy regions are formed downstream of other steps where the distance between tangent line 52 and the stopper nose surface Increases quickly, as illustrated by arrows 55 and 60. Thus, in the Invention the location and scale of the turbulent eddy regions are controlled by the location and depth of the ripples on the stopper nose surface.

In this embodiment of the invention, the deficiencies of previous stopper rod systems are corrected by providing a stopper rod system with a uniquely-designed stopper nose that controls the scale and location of turbulence in the metal flow. The controlled turbulence reduces the rate of clogging deposition on the stopper nose by continuously sweeping away any non-metallic particles. In addition, if gas is introduced into the system through the stopper nose, the controlled turbulence adjacent to the stopper nose surface distributes the gas bubbles uniformly around the stopper nose to further inhibit any clogging deposition.

FIG. 7 illustrates an additional alternate embodiment of the present invention. In this embodiment, the surface of the nozzle bore 71 is ripple-shaped so as to form a flow channel between the tangent line and the nozzle bore 71 that progressively increases in size, in a discontinuous manner, as the distance downstream of the contact point 57 increases. This discontinuous increase in flow channel size is similar to that described above in relation to FIGS. 5-6.

At the point of contact 57 between the stopper rod nose 70 and the nozzle bore 71, a tangent line 58 has been drawn tangent to the nozzle bore 71 surface extending downstream from the contact point. The rippled shape of the nozzle bore 71 provides that the flow channel size between the tangent line and the nozzle bore 71 does not decreases as a function of the distance downstream of the point of contact 57. Instead, the flow channel size increases as distance downstream of the aperture increases, in a series of steps, with first a slow increase adjacent to the contact point to assure good closure, followed by a fast increase, followed by a slow increase or even no increase, followed by a fast increase, followed by a slow or no increase, etc. This causes the formation of turbulent eddy regions in the flow channel adjacent to the nozzle bore surface downstream of the steps where the distance between tangent line and the nozzle bore surface increases quickly. In this way, the stopper rod system of this embodiment of the present invention controls the location and scale of the turbulent eddies.

FIG. 8 shows another embodiment of the invention in which both the stopper nose 81 and the nozzle bore 83 are rippled. In this embodiment, as described above with respect to the previous embodiments, the flow channel between the nozzle bore tangent line and the nozzle bore surface and the flow channel between the stopper nose tangent line and the stopper nose surface progressively increases in size, in a step-wise manner, downstream of the aperture. This controls the turbulence in the liquid metal flow both adjacent to the nozzle bore surface and adjacent to the stopper nose surface downstream of the aperture.

Obviously, numerous modifications and variations of the present invention are possible. It is, therefore, to be understood that within the scope of the following claims, the invention may be practiced otherwise than as specifically described.

We claim:

1. A stopper rod system for use in a metallurgical vessel, comprising a stopper rod having a nose on one end thereof, and a nozzle having a bore therethrough, the bore having an internal surface, the stopper rod nose and the internal surface of the nozzle bore having a point of contact when the stopper rod system is in a closed position; wherein at least one of the stopper rod nose and the internal surface of the nozzle bore comprises a plurality of ripples that are arranged such that the size of a flow channel when the stopper rod system is in an open position discontinuously increases in size as a function of the distance downstream from the point of contact, wherein the size of the flow channel does not decrease downstream from the point of contact, and wherein the flow channel contains a single constriction.

2. A stopper rod system according to claim 1, wherein the increase in size of the flow channel due to the ripple nearest the point of contact is greater than the increase in size of the flow channel due to the ripple immediately downstream of the ripple nearest the point of contact.

3. A stopper rod system according to claim 1, wherein the increase in size of the flow channel due to each successive ripple is alternately larger and smaller than the last with each successive ripple downstream from the point of contact.

4. A stopper rod system according to claim 1, wherein the stopper rod nose comprises the plurality of ripples.

5. A stopper rod system according to claim 1, wherein the internal surface of the nozzle bore comprises the plurality of ripples.

6. A stopper rod system according to claim 1, wherein both of the stopper rod nose and the internal surface of the stopper bore comprise a plurality of ripples.

7. A stopper rod for use in a stopper system, the stopper rod system comprising the stopper rod having a nose on one end thereof, and a nozzle having a bore therethrough, the bore having an internal surface, the stopper rod nose and the internal surface of the bore having a point of contact when the stopper rod system is in a closed position; wherein the stopper rod nose comprises a plurality of ripples that are arranged such that the size of a flow channel when the stopper rod system is in an open position discontinuously increases in size as a function of the distance downstream from the point of contact, wherein the size of the flow channel does not decrease downstream from the point of contact, and wherein the flow channel contains a single constriction.

8. A stopper rod according to claim 7, wherein the increase in size of the flow channel due to the ripple nearest the point of contact is greater than the increase in the size of the flow channel due to the ripple immediately downstream of the ripple nearest the point of contact.

9. A stopper rod according to claim 7, wherein the increase in size of the flow channel due to each successive ripple is alternately larger and smaller than the last with each successive ripple downstream from the point of contact.

10. A nozzle for use in a stopper rod system, the stopper rod system comprising a stopper rod having a nose on one end thereof, and the nozzle having a bore therethrough, the bore having an internal surface, the stopper rod nose and the internal surface of the bore having a point of contact when the stopper rod system is in a closed position; wherein the internal surface of the nozzle bore comprises a plurality of ripples that are arranged such that the size of a flow channel when the stopper rod system is in an open position discontinuously increases in size as a function of the distance downstream from the point of contact, wherein the size of the flow channel does not decrease downstream from the point of contact, and wherein the flow channel contains a single constriction.

11. A nozzle according to claim 10, wherein the increase in size of the flow channel due to the ripple nearest the point of contact is greater than the increase in size of the flow channel due to the ripple immediately downstream of the ripple nearest the point of contact.

12. A nozzle according to claim 10, wherein the increase in size of the flow channel due to each successive ripple is alternately larger and smaller than the last with each successive ripple downstream from the point of contact.

* * * * *